US008248356B2

(12) United States Patent
Chen

(10) Patent No.: US 8,248,356 B2
(45) Date of Patent: Aug. 21, 2012

(54) DRIVING CIRCUIT FOR DETECTING LINE SHORT DEFECTS

(75) Inventor: Chih-Ping Chen, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 971 days.

(21) Appl. No.: 12/257,407

(22) Filed: Oct. 24, 2008

(65) Prior Publication Data

US 2010/0103184 A1 Apr. 29, 2010

(51) Int. Cl.
*G09G 3/36* (2006.01)

(52) U.S. Cl. ..... 345/100; 345/98; 345/211

(58) Field of Classification Search ..... 345/98–100, 345/211–213; 380/265
See application file for complete search history.

(56) References Cited

U.S. PATENT DOCUMENTS

| | | | | |
|---|---|---|---|---|
| 7,145,545 | B2 * | 12/2006 | Zebedee et al. | 345/100 |
| 7,248,243 | B2 * | 7/2007 | Murakami et al. | 345/98 |
| 7,289,090 | B2 * | 10/2007 | Morgan | 345/82 |
| 7,688,933 | B2 * | 3/2010 | Morosawa | 377/64 |
| 7,719,510 | B2 * | 5/2010 | Guo et al. | 345/100 |
| 2002/0149318 | A1 * | 10/2002 | Jeon et al. | 315/169.1 |
| 2007/0040792 | A1 * | 2/2007 | Kwag et al. | 345/100 |
| 2007/0182686 | A1 * | 8/2007 | Chen et al. | 345/98 |
| 2010/0097009 | A1 * | 4/2010 | Lin et al. | 315/297 |

* cited by examiner

*Primary Examiner* — Kimnhung Nguyen
(74) *Attorney, Agent, or Firm* — Winston Hsu; Scott Margo

(57) ABSTRACT

For detecting line short defects in a display panel, a driving circuit has a plurality of shift registers, a plurality of diode modules, and at least one power supply. Each shift register has an output port for outputting a driving signal sequentially. The diode modules are coupled to the output ports of the shift registers accordingly. The power supply is coupled to the diode modules and forward biases the diode modules to bypass the shift registers during at least a part of a period of detecting line short defects.

9 Claims, 7 Drawing Sheets

DRIVING CIRCUIT FOR DETECTING LINE SHORT DEFECTS

BACKGROUND OF THE INVENTION

1. Field of the Invention

The present invention relates to a method for detecting line short defects in a display panel, and more particularly, to a driving circuit for detecting line short defects in a GOA (gate-on-array) display panel.

2. Description of the Prior Art

Thin film transistor liquid crystal displays (TFT-LCDs) are commonly utilized in, for example, televisions and flat panel displays. Each pixel of the TFT-LCDs has a layer of liquid crystal located between two substrates and is controlled by voltage applied across the two substrates. The TFT-LCDs have a plurality of column lines and a plurality of row lines crossing the plurality of column lines to constitute a pixel matrix. A plurality of transistors is respectively deposited in the pixel matrix on one of the substrates. Each transistor has a gate coupled to the plurality of row lines correspondingly, and a drain/source coupled to the plurality of column lines correspondingly. Individual pixels may then be turned on by appropriate application of a row signal and a column signal transmitted through the row line and the column line, respectively.

As TFT-LCD technology improves, number and density of the pixels of the TFT-LCDs both increase dramatically. To fit more pixels into the same area, i.e. increase resolution, both row lines and column lines must be packed closer together. Thus, a process defect may cause two adjacent row/column lines to form one kind of line short defect (also named "GG/SS short",) or overlapping row and column lines to form another kind of line short defect (also named "SG short".)

In another aspect, to decrease cost, part of a driving circuit may be deposited on the substrate directly, and the devices thereof, e.g. shift registers, are manufactured during the process of fabricating the plurality of transistors in the pixel matrix. FIG. 1 is a driving circuit diagram of a TFT-LCD panel employing gate-on-array (GOA) technology. The shift registers 101-103 are manufactured during the process of manufacturing the plurality of transistors in the pixel matrix, and are coupled in series, e.g. from an output port OUT1 of the first shift register 101 to an input S of the second shift register 102, and so forth.

First, the output port Q1 of first register 101 provides a driving signal OUT1 to the pixel matrix (also called a display area) according to an input signal VST, and clock signals CK and XCK may be provided from a generator. Then, the output port Q2 of the second register 102 provides a driving signal OUT2 to the display area. Due to sequential output, which is a limitation of the GOA technology, the shift registers 101-103 are unavailable to detect the accurate coordinates of line short defects through an array tester, e.g. a shorting-bar array tester. Thus, not only does the factory suffer array process yield loss, but manufacturing resources are also wasted.

SUMMARY OF THE INVENTION

According to an embodiment of the present invention, a driving circuit for detecting line short defects in a display panel comprises a plurality of shift registers, a plurality of diode modules, and a power supply. Each shift register has an output port for outputting a driving signal sequentially to a display area. Each diode module is coupled to the output ports of the plurality of shift registers accordingly. The power supply is coupled to the plurality of diode modules and forward biases the diode modules to bypass the shift registers during at least a part of period of detecting line short defects.

According to the above embodiment, a method for detecting line short defects in a GOA display panel having a plurality of shift registers deposited on a substrate, a plurality of diode modules and a power supply comprises checking whether any line defect exists; providing a voltage to forward bias the diode modules to bypass the shift registers if there is any line defect on the substrate; detecting the location of the largest voltage drop on the substrate; passing the detected location back to the array tester.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
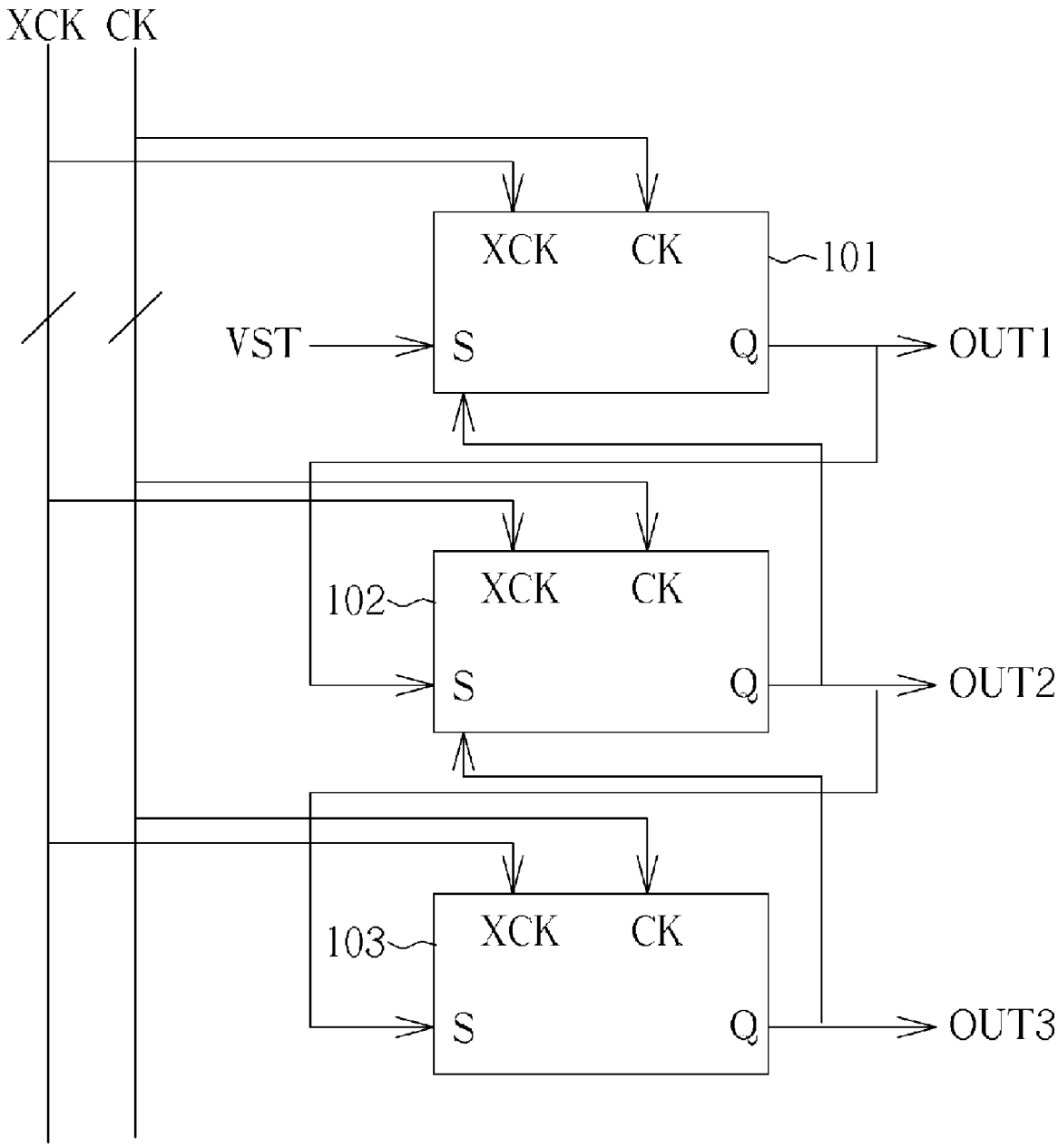
FIG. 1 PRIOR ART
FIG. 1 is a diagram of shift registers utilized in a TFT-LCD panel employing gate-on-array technology.
Figure 2:
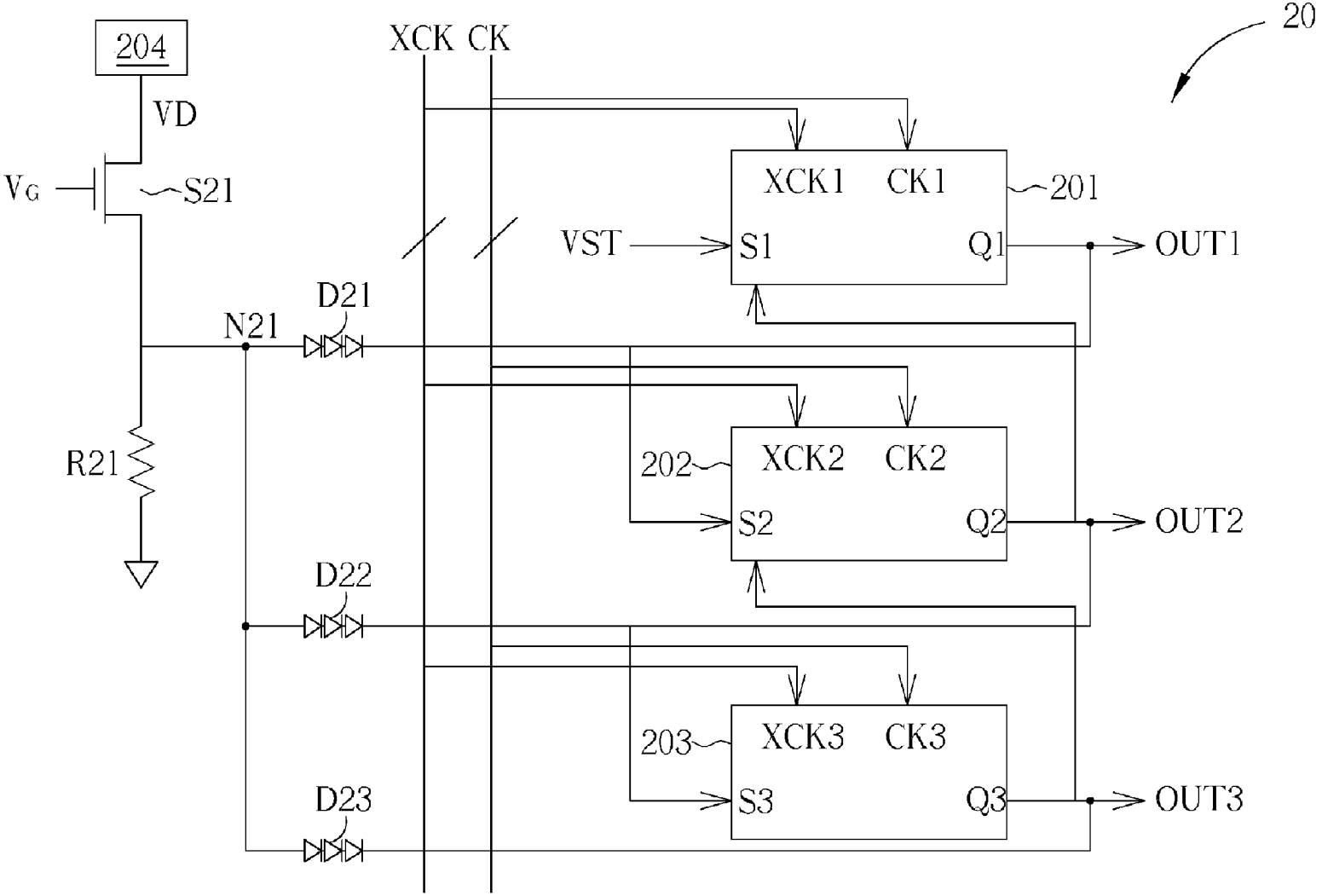
FIG. 2 is a diagram of a driving circuit for detecting line short defects according to a first embodiment.

Please refer to FIG. 2, which is a diagram of a driving circuit 20 for detecting line short defects according to a first embodiment. The driving circuit 20 comprises a plurality of shift registers 201-203, a plurality of diode modules D21-D23 and a power supply VD. The shift registers 201-203 are manufactured during fabrication of the plurality of transistors in the pixel matrix and are coupled in series, e.g. from an output port OUT1 of the first shift register 201 to an input S1 of the second shift register 202, and so forth.

First, the output port Q1 of the first shift register 201 provides a driving signal OUT1 to the pixel matrix (also named a display area) according to an input signal VST, and the clock signals CK and XCK, may be provided from a generator. Then, the output port Q2 of the second register 202 provides a driving signal OUT2 to the display area. The diode modules D21-D23 are respectively coupled to the output ports Q1-Q3 of the plurality of shift registers 201-203. And, the power supply 204 is coupled to the plurality of diode modules D21-D23 to provide a forward bias to the diode modules D21-D23. In the embodiment, the driving circuit 20 further comprises a switch S21 and a resister R21, which may be simultaneously manufactured during the manufacturing process of the plurality of transistors in the pixel matrix. The switch S21, e.g. a transistor switch, is coupled between the power supply 204 and the diode modules D21-D23 to control the power supply 204 to transmit the forward bias to the diode modules D21-D23 according to a control signal VG. Each diode module may comprise a plurality of diodes or diode-coupled transistors in series. The resistor R21 is coupled between the node N21 and the ground. The node N21 is located between the switch S21 and the diode modules D21-

D23. In normal operation, the switch S21 is off according to the control signal VG that is low. The diode modules D21-D23 are regarded as open circuits and do not effect the normal operation.

When used to detect line short defects, the switch S21 is turned on as the control signal VG is high, and the supply power VD transmits the forward bias to the diode modules D21-D23 via the switch S21.

Figure 3:
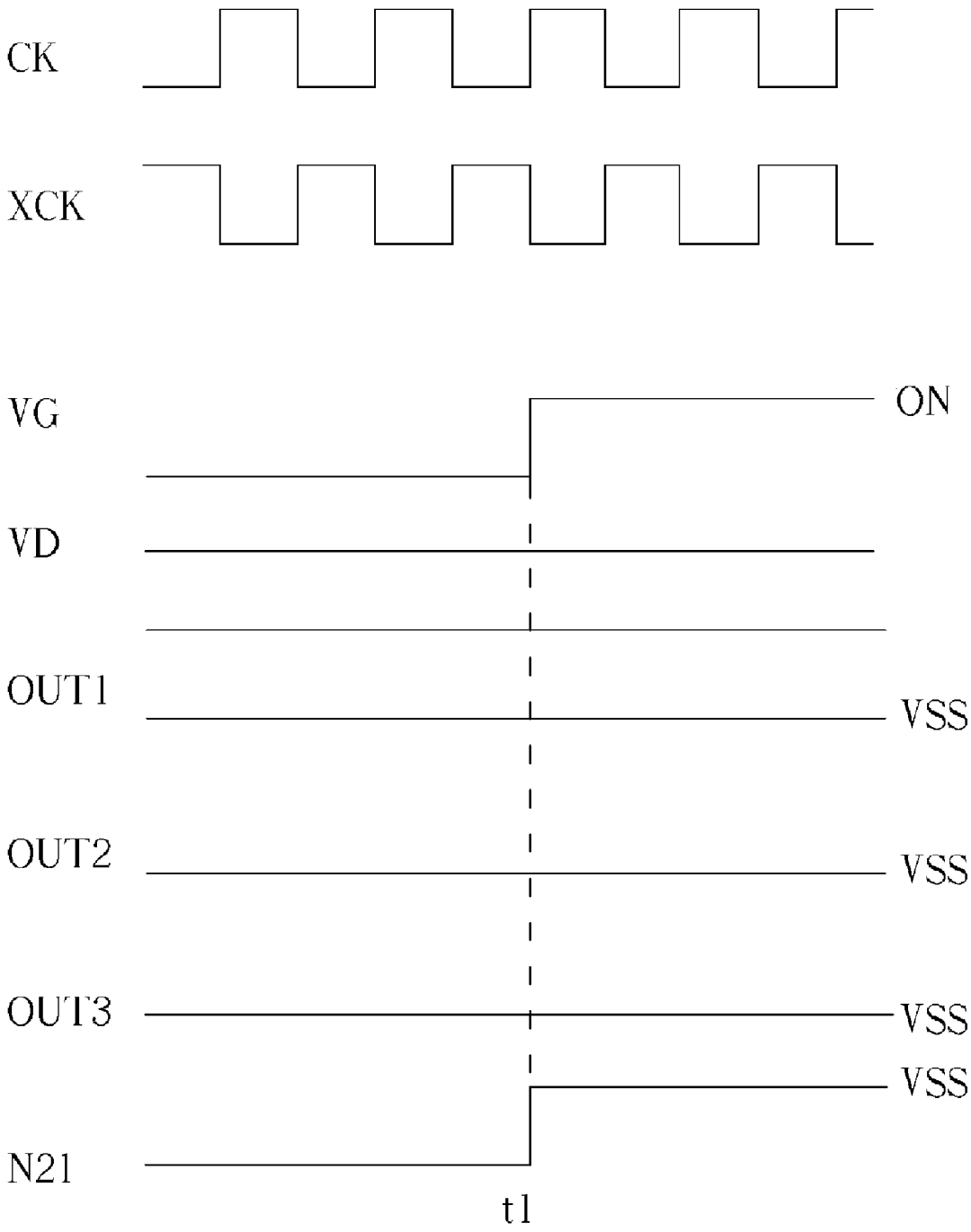
FIG. 3 is a timing diagram illustrating a line short defect detection operation of the driving circuit of FIG. 2.

Please refer to FIG. 3, which is a timing diagram illustrating a line short defect detection operation of the driving circuit according to the first embodiment. Initially, when an array tester is checking whether any line defects exist, the driving signals OUT1-OUT3, e.g. VSS, provided by the shift registers 201-203, are high, the control signal VG is low, and the power supply signal VD is high. If a line defect exists on the substrate, the switch S21 is turned on as the control signal VG transitions from low to high at t1, and transmits a voltage, e.g. VD, of the forward bias, to the diode modules D21-D23. At this time, the diode modules D21-D23 are regarded as short circuits and bypass the shift registers 201-203. Because there is a line short defect in the display area, the voltage level of the node N21 is lower than VSS, the driving signal provided by the shift registers 201-203 originally. Then, the array tester detects the location of the line short defect, e.g. the largest voltage drop in the display area, and finally, the results are passed back to the array tester.

In the embodiment, if the power supply 204 can be controlled according to the timing of transmitting the forward bias to the diode modules D21-D23, the switch S21 is optional. Oppositely, if the power supply 204 is a constant supply, the timing of transmitting the forward bias to the diode modules D21-D23 is controlled by the switch S21 (as in the embodiment above).

Figure 4:
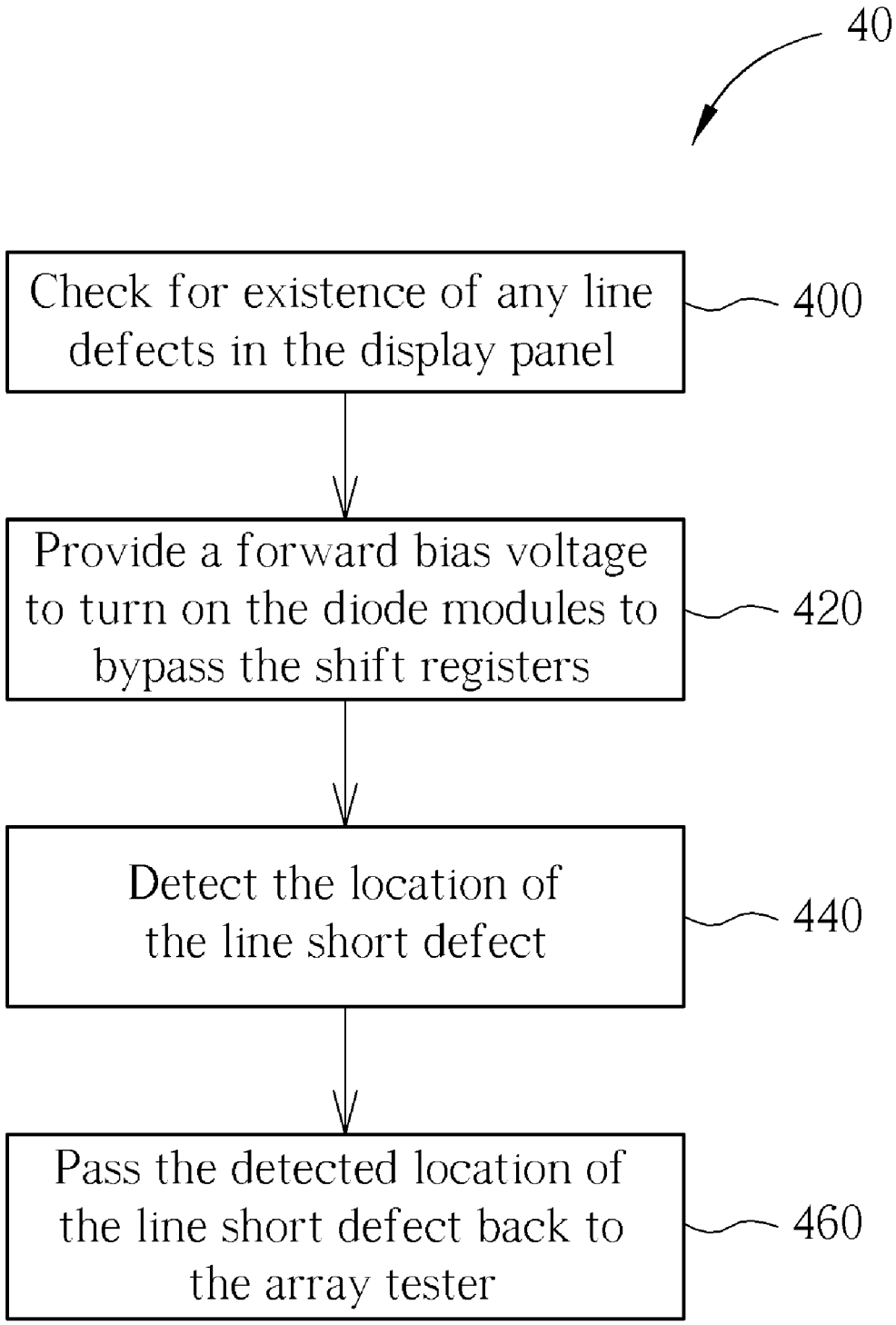
FIG. 4 is a flowchart diagram of a method for detecting line short defects corresponding to FIG. 2.

Please refer to FIG. 4, which is a flowchart diagram of a method 40 for detecting line short defects according to the first embodiment. The method 40 includes the following steps.

Step 400: Check for existence of any line defects in the display panel.

Step 420: Provide a forward bias voltage to turn on the diode modules to bypass the shift registers.

Step 440: Detect the location of the line short defect.

Step 460: Pass the detected location of the line short defect back to the array tester.

In the method 40, when a line defect exists on the substrate, the switch S21 is turned on while the control signal VG is high, and transmits a forward bias voltage to the diode modules D21-D23 (Step 420). The array tester detects the location of the line short defect, e.g. the largest voltage drop in the display area (Step 440).

For example, if a row line is shorted with a pixel electrode and/or a column line, the voltage will be dropped from the pixel electrode and/or the column line in the display area. First, an array tester detects a line defect on the substrate, e.g. the electric potential is abnormal on the substrate. Then, the power supply 204 provides a forward bias voltage to the diode modules D21-D23 to bypass the shift registers 201-203 so as to enhance the abnormality. The array tester performs detection on the display area pixel-by-pixel to determine the location, e.g. the location having highest electric potential change. Finally, the result, e.g. coordinates of the location, is transferred to the array tester.

Figure 5:
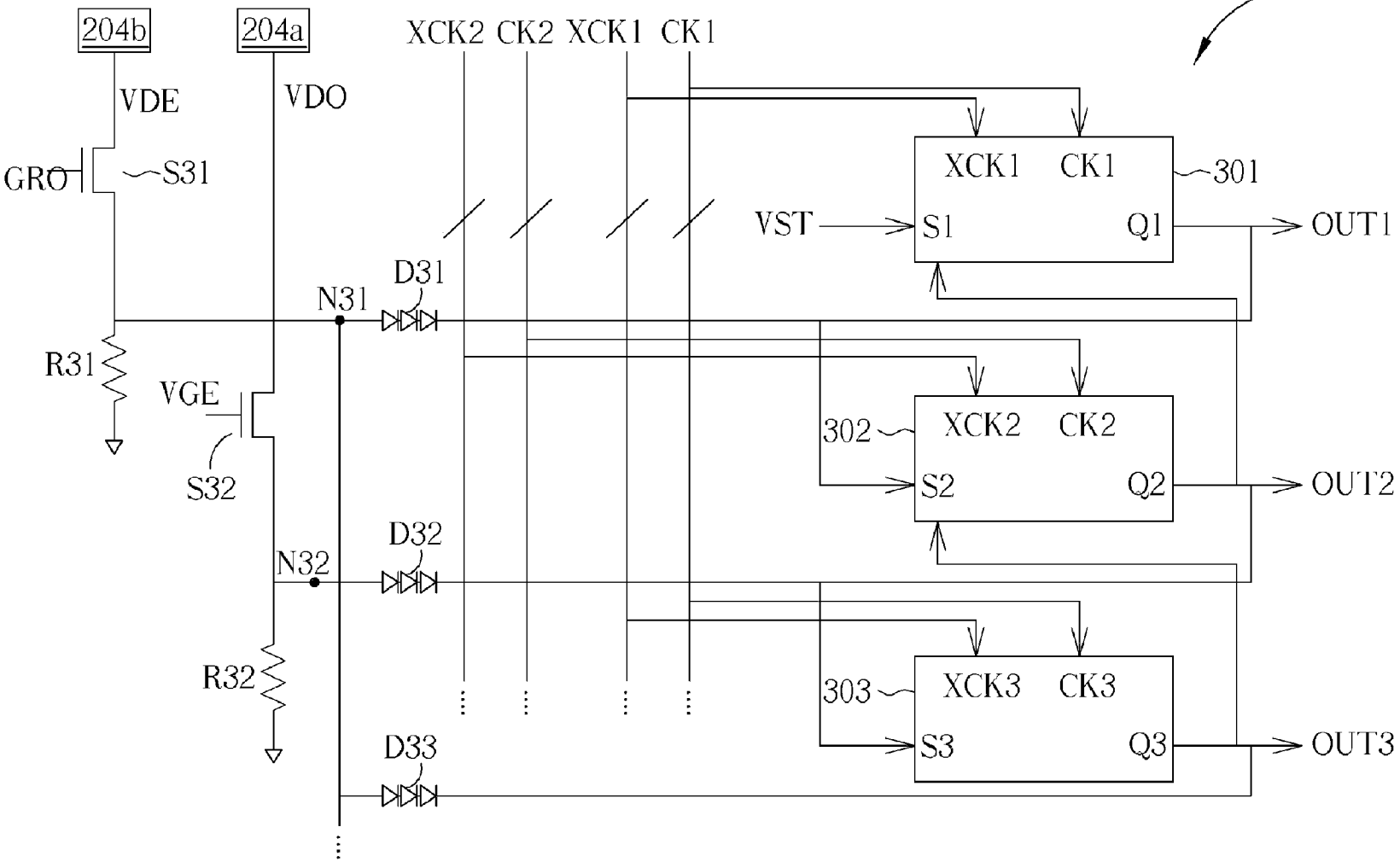
FIG. 5 is a diagram of a driving circuit for detecting line short defects according to a second embodiment.

Please refer to FIG. 5, which is a diagram of a driving circuit 30 for detecting line short defects according to a second embodiment. The driving circuit 30 comprises a plurality of shift registers 301-303, a plurality of diode modules D31-D33 and two power supplies VDO and VDE. The shift registers 301-303 are divided into two groups, the odd group comprising shift registers 301 and 303 and the even group comprising shift registers 302. The function of the shift registers 301-303 can be referred from FIG. 2, so as not to give redundant details. The diode modules D31-D33, which may comprise a plurality of diodes or diode-coupled transistors coupled in series respectively, are also divided to two groups: the odd group comprises the diode modules D31 and D33, and the even group comprises the diode module D32. The diode modules D31-D33 are respectively coupled to the output ports Q1-Q3 of the plurality of shift registers 301-303.

The power supplies VDO and VDE are coupled to the odd group of the diode modules D31 and D33 and the even group of the diode modules D32 to provide forward biases to the diode modules D31-D33, respectively. In the embodiment, the driving circuit 30 further comprises two switches S31 and S32 and two resisters R31 and R32 which may be simultaneously manufactured during the manufacturing process of the plurality of transistors in the pixel matrix. The switch S31, e.g. a transistor switch, is coupled between the power supply 204*a* and the odd group of the diode modules D31 and D33 to control the power supply 204*a* to transmit the forward bias to the odd group of the diode modules D31 and D33 according to a control signal VGO. The resistor R31 is coupled between the node N31 and the ground. The node N31 is located between the switch S31 and the odd group of the diode modules D31 and D33. The switch S32, e.g. a transistor switch, is coupled between the power supplies VDE and the even group of the diode module D32 to control the power supply 204*b* to transmit the forward bias to the even group of the diode module D32 according to a control signal VGE. The resistor R32 is coupled between the node N32 and the ground. The node N32 is located between the switch S32 and the even group of the diode module D32. In normal operation, the switches S31 and S32 are off according to the control signals VGO and VGE, which are low. The diode modules D31-D33 are regarded as open circuits and do not effect the normal operation.

When used to detect line short defects, more specifically an adjacent line short defect, one of the switches S31 and S32 is turned on as the control signal VGO or VGE is high, and the supply power VDO or VDE provides the forward bias to the odd group of the diode modules D31 and D33 via the switch S31 or the even group of the diode module D32 via the switch S32.

Figure 6:
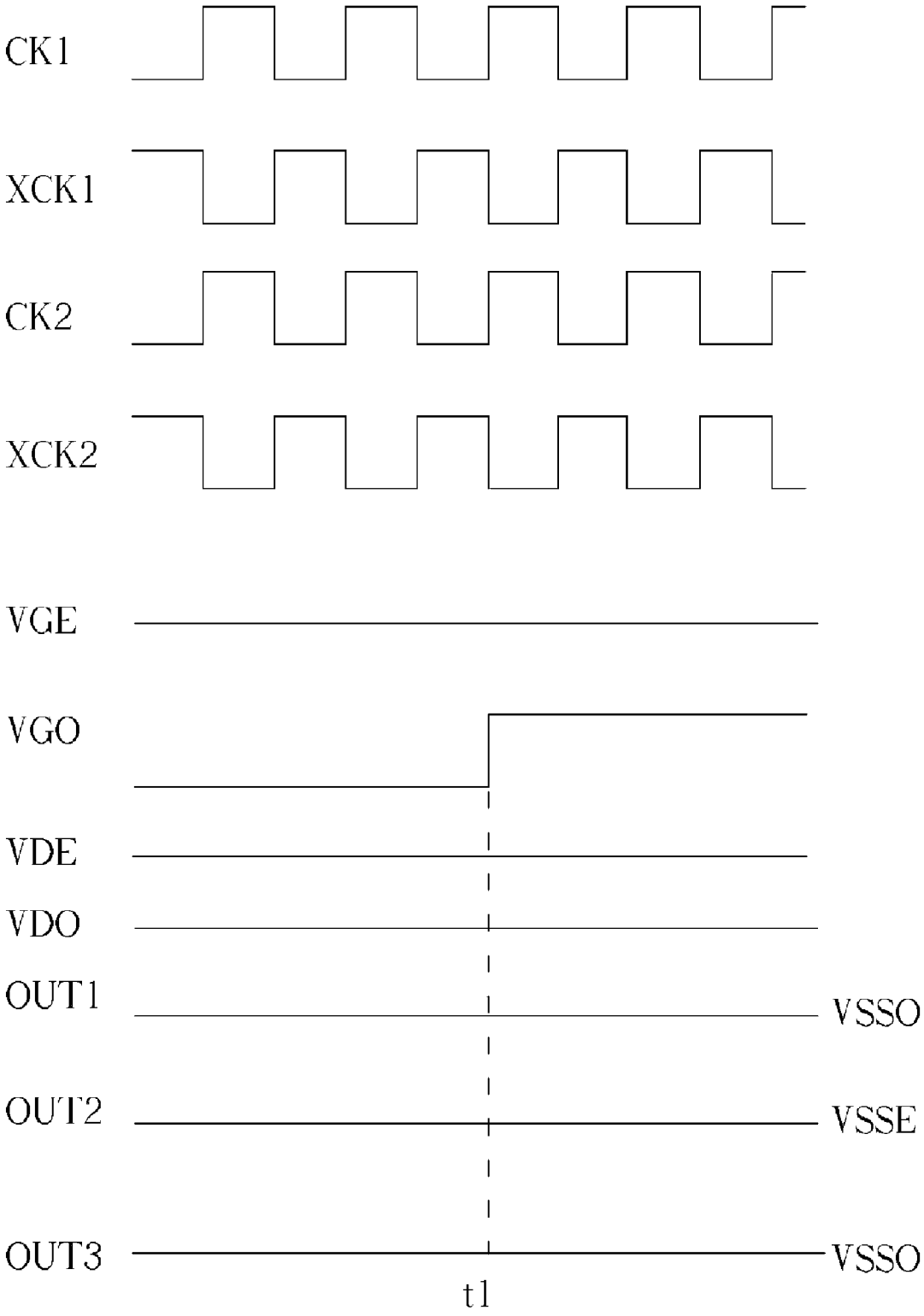
FIG. 6 is another timing diagram illustrating a line short defect detection operation of the driving circuit of FIG. 5.

Please refer to FIG. 6, which is a timing diagram illustrating a line short defect detection operation of the driving circuit in the second embodiment. In this embodiment, the odd group of shift registers 301 and 303 provides driving signals OUT1 and OUT3 with high level, e.g. VSSO, to the display area, and the even group of shift registers 302 provides a driving signal OUT2 with low level, e.g. VSSE, to the display area. Initially, the control signals VGE and VGO are both low and the power supplies VDE and VEO are both high, when an array tester is checking whether any line defects exist. Second, if there is a line defect on the substrate, the switch S31 is turned on as the control signal VGO transitions from low to high at t1, and transmits a voltage, e.g. the supply power VDO, of the forward bias to the odd group of diode modules D31 and D33 via the switch S31. At this time, the odd group of diode modules D31 and D33 are regarded as short circuit and bypass the shift registers 301 and 303. Because no voltage is transmitted to the even group of diode module D32, the diode module D32 is still regarded as an open circuit. Because there is a line short defect, more specifically an adjacent line short defect, in the display area, the voltage level of the node N31 will be lower than VSSO provided by the odd shift registers 301 and 303 originally. Then, the array tester detects the location where the line short defect is, e.g. by detecting the largest voltage drop in the display area.

Like the first embodiment, if the power supplies VDO and VDE can be controlled according to the timing of transmitting the forward bias to the diode modules D31-D33, the switches S31 and S32 are optional. Oppositely, if the power supplies VDO and VDE are constant supplies, the timing of transmitting the forward bias to the diode modules D31-D33 is controlled by the switches S31 and S32.

Figure 7:
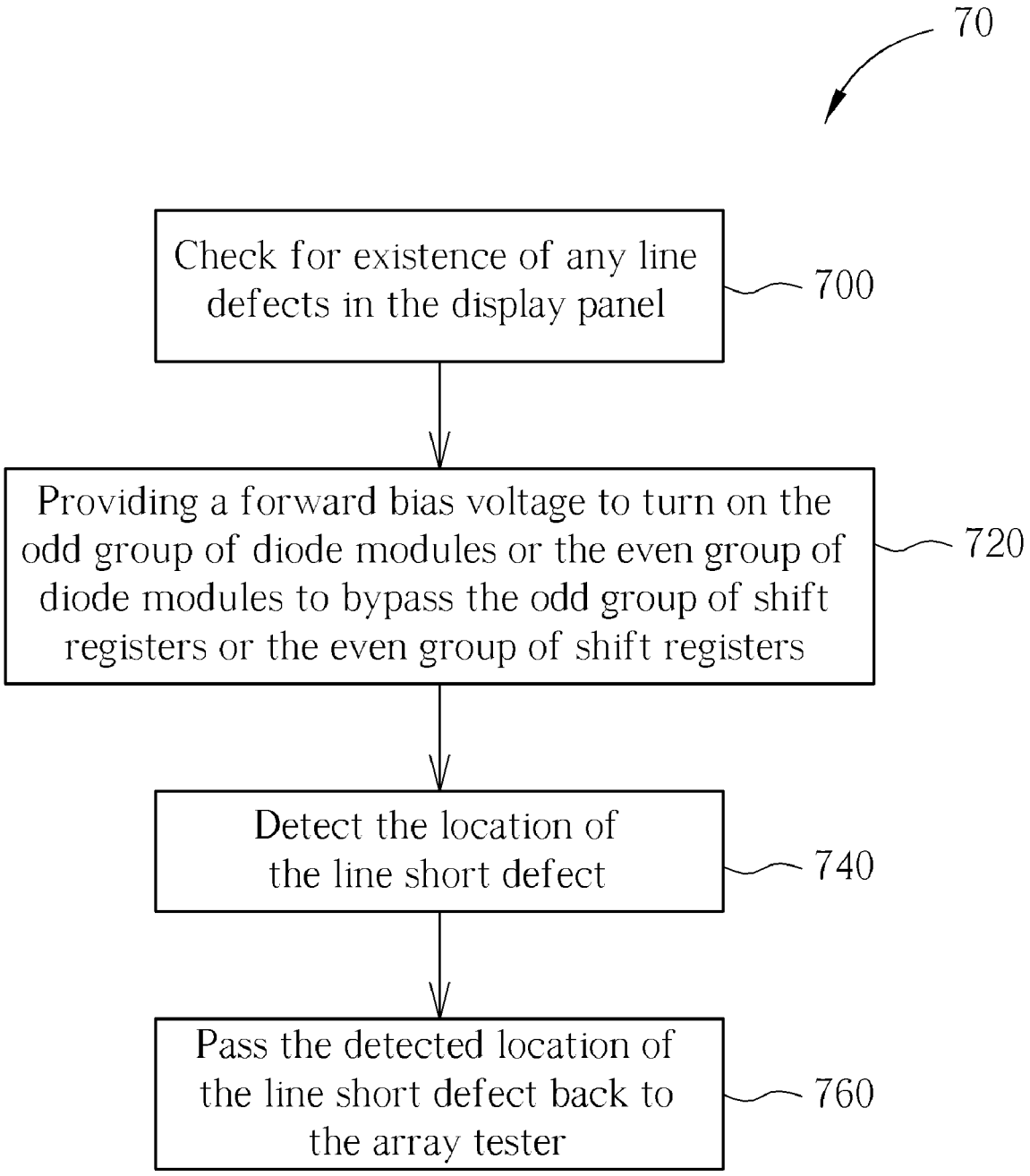
FIG. 7 is a flowchart diagram of a method for detecting line short defects in a second embodiment.

Please refer to FIG. 7, which is a flowchart diagram of a method 70 for detecting line short defects in the second embodiment.

Step 700: Check whether any line defects exist in the display panel.

Step 720: Provide a forward bias voltage to turn on the odd group of diode modules or the even group of diode modules to bypass the odd group of shift registers or the even group of shift registers.

Step 740: Detect the location of the line short defect.

Step 760: Pass the detected location of the line short defect back to the array tester.

In the method 70, when a line defect exists on the substrate, one of the switches S31 and S32 is turned on as one of the control signals VGO and VGE is high, and transmits a forward bias voltage to the odd group of diode modules D31 and D33 via the switch S31 or to the even group of diode module D32 (Step 720). The array tester detects the location of the line short defect, e.g. the location where the voltage drops most (Step 740), and passes the coordinates back to the array tester (Step 760).

For example, if there is a row line shorted with an adjacent row line, the voltage will be dropped from the adjacent row line in the display area (or the row line, depending upon the values of the driving signal to the display area). First, an array tester detects a line defect on the substrate, e.g. the electric field is unequal to a normal structure. Then, the power supply 204*a* provides a voltage of forward bias to the odd group diode modules D31 and D33 to bypass the shift registers 301 and 303, so as to enhance the abnormality. The array tester performs detection on the display area pixel-by-pixel to determine the location, e.g. the location where the voltage drops most, and the information, e.g. the coordinates, is passed back to the array tester.

In the second embodiment, the shift registers 301-303 and the diode modules D31-D33 are divide into two groups respectively, however no limitation is made on number of the groups. A person having ordinary skill in the art can appropriately divide them in practice.

The quantity of the devices, e.g. the shift registers, the diode modules, and the switches, described above is used for illustration purposes only, and are not limitations in this invention.

According to the driving circuit for detecting line short defects in a display panel and the method for detecting a line short defect in a GOA panel described above, the limitation of the GOA technology is overcome successfully. The line short defects can be detected accurately and rapidly, which not only improves the array process yield, but also increases profits through lower cost of manufacture.

Those skilled in the art will readily observe that numerous modifications and alterations of the device and method may be made while retaining the teachings of the invention.

What is claimed is:

1. A driving circuit for detecting line short defects in a display panel having a pixel matrix, the driving circuit comprising:

a plurality of shift registers, each shift register having an output port for outputting a driving signal sequentially;

a plurality of diode modules coupled to the output ports of the plurality of shift registers respectively; and at least one power supply coupled to the plurality of diode modules for providing a forward bias to the diode modules to bypass the plurality of shift registers simultaneously during at least a part of a period of detecting line short defects.

2. The driving circuit of claim 1, wherein the diode module comprises a plurality of diodes or diode-coupled transistors coupled in series.

3. The driving circuit of claim 1, further comprising at least one switch coupled between the at least one power supply and the plurality of diode modules.

4. The driving circuit of claim 1, wherein the plurality of shift registers are divided into an odd group of shift registers and an even group of shift registers, the plurality of diodes are divided into an odd group of diode modules and an even group of diode modules, each diode module of the odd group of diode modules is coupled to an output port of the odd group of shift registers, each diode module of the even group of diode modules is coupled to an output port of the even group of shift registers, and the at least one power supply comprises two power supplies coupled to the odd group of diode modules and the even group of diode modules, respectively.

5. The driving circuit of claim 4, further comprising two switches coupled between the two power supplies and the odd group of diode modules and between the two power supplies and the even group of diode modules, respectively.

6. A method for detecting line short defects using the driving circuit of claim 5, the method comprising:

checking whether any line defects exist when the line short defect exists;

providing a forward bias voltage to one of the odd group of diode modules and the even group of diode modules to bypass one of the odd group of shift registers and the even group of shift registers; and detecting the location of the line short defect.

7. The method of claim 6, further comprising passing the detected location after detecting the location of the line short defect.

8. A method for detecting line short defects in a display panel using the driving circuit of claim 1, the method comprising steps of:

checking whether any line defects exist in the display panel;

providing a forward bias voltage to the diode module to bypass the plurality of the shift registers when the line short defect exists; and detecting the location of the line short defect.

9. The method of claim 8, further comprising passing the detected location after detecting the location of the line short defect.

* * * * *